US010934785B2

(12) United States Patent
Fripp et al.

(10) Patent No.: US 10,934,785 B2
(45) Date of Patent: Mar. 2, 2021

(54) DOWNHOLE WET CONNECTION SYSTEMS

(71) Applicant: Halliburton Energy Services, Inc., Houston, TX (US)

(72) Inventors: Michael Linley Fripp, Carrollton, TX (US); Thomas Jules Frosell, Irving, TX (US); Aswin Balasubramanian, Spring, TX (US); Stephen Michael Greci, Little Elm, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 16/331,448

(22) PCT Filed: Jun. 5, 2017

(86) PCT No.: PCT/US2017/035975
§ 371 (c)(1),
(2) Date: Mar. 7, 2019

(87) PCT Pub. No.: WO2018/226207
PCT Pub. Date: Dec. 13, 2018

(65) Prior Publication Data

US 2019/0195028 A1 Jun. 27, 2019

(51) Int. Cl.
*E21B 17/02* (2006.01)
*E21B 33/038* (2006.01)
(Continued)

(52) U.S. Cl.
CPC ..... *E21B 17/028* (2013.01); *E21B 33/0385* (2013.01); *E21B 47/017* (2020.05);
(Continued)

(58) Field of Classification Search
CPC ... E21B 17/028; E21B 17/003; H01R 13/005; H01R 3/08
See application file for complete search history.

(56) References Cited

U.S. PATENT DOCUMENTS 4,866,607 A 9/1989 Anderson et al.
5,389,003 A * 2/1995 Van Steenwyk ..... E21B 17/028 439/190
(Continued)

FOREIGN PATENT DOCUMENTS

WO 9623368 8/1996
WO 2016108845 A1 7/2016
(Continued)

OTHER PUBLICATIONS

International Search Report and Written Opinion dated Dec. 6, 2017; International PCT Application No. PCT/US2017/035975.
(Continued)

*Primary Examiner* — Catherine Loikith
(74) *Attorney, Agent, or Firm* — McGuireWoods LLP

(57) ABSTRACT

Downhole wet connection systems, and methods and apparatuses to provide an electrical connection between two downhole strings. In one embodiment, a wet connection system having a first electrode coupled to a load and deployed in a wellbore. The wet connection system also includes a second electrode deployed along a string deployed in the wellbore and proximate to the first electrode. Further, the first electrode and the second electrode form a wet connection to transmit alternating current from the second electrode to the first electrode.

19 Claims, 6 Drawing Sheets

(51) Int. Cl.

| | |
|---|---|
| ***E21B 47/017*** | (2012.01) |
| ***H01R 3/08*** | (2006.01) |
| ***H01R 13/15*** | (2006.01) |
| *E21B 43/08* | (2006.01) |
| *E21B 47/00* | (2012.01) |
| *E21B 47/12* | (2012.01) |

(52) U.S. Cl.
CPC ..... *H01R 3/08* (2013.01); *H01R 13/15* (2013.01); *E21B 43/08* (2013.01); *E21B 47/00* (2013.01); *E21B 47/12* (2013.01)

(56) References Cited

U.S. PATENT DOCUMENTS

| | | | | |
|---|---|---|---|---|
| 7,165,618 | B2 * | 1/2007 | Brockman | E21B 17/028 166/313 |
| 8,102,276 | B2 | 1/2012 | Sugiura | |
| 8,469,084 | B2 | 6/2013 | Clark et al. | |
| 8,567,524 | B2 | 10/2013 | Schimanski | |
| 8,925,627 | B2 * | 1/2015 | Tupper | E21B 17/20 166/302 |
| 9,007,233 | B2 | 4/2015 | Sugiura | |
| 2004/0094303 | A1 | 5/2004 | Brockman et al. | |
| 2006/0144089 | A1 * | 7/2006 | Eichholz | C03B 5/235 65/29.21 |
| 2006/0243450 | A1 | 11/2006 | Head | |
| 2008/0223585 | A1 | 9/2008 | Patel et al. | |
| 2011/0100620 | A1 | 5/2011 | Patel | |
| 2012/0006444 | A1 | 1/2012 | Tupper et al. | |
| 2013/0087321 | A1 | 4/2013 | Bartko et al. | |
| 2013/0319685 | A1 | 12/2013 | Pike | |
| 2016/0356911 | A1 | 12/2016 | Wilson et al. | |

FOREIGN PATENT DOCUMENTS

| | | | |
|---|---|---|---|
| WO | 2016175827 | A1 | 11/2016 |
| WO | 2017003490 | A1 | 1/2017 |

OTHER PUBLICATIONS

"Capacitive Power Transfer", MS Thesis from UC-Berkley in Electrical Engineering. Dec. 15, 2010; http://www2.eecs.berkeley.edu/Pubs/TechRpts/2010/EECS-2010-155.pdf.

"Conductive Inductive and Capacitive Subsea Connectors—Horses for Courses," Society of Underwater Technology, Subsea Control and Data Acquisition: Proceedings of an international conference, Apr. 4-5, London, UK, 1990.

"New Developments In Inductive and Capacitive Underwater Electrical Connectors," Offshore Technology Conference, May 2-5, Houston, Texas, 1988.

* cited by examiner

DOWNHOLE WET CONNECTION SYSTEMS

BACKGROUND

The present disclosure relates generally to downhole wet connection systems, and methods and apparatuses to form downhole wet connections in downhole environments.

Electrical components, such as sensors, actuators, generators, pumps, tools, as well as other types of electrical loads (collectively "loads") are sometimes deployed in a wellbore of a well to facilitate hydrocarbon exploration and production. Loads are sometimes deployed hundreds or thousands of feet under the surface for extended periods of time. Further, some loads are deployed on a portion of the well, such as a lower completion, that is permanently deployed downhole or may not be readily receivable. Some loads are connected to battery sources to provide power to such loads. However, battery sources store finite amounts of energy and need to be periodically recharged.

An umbilical having an electrical conduit is sometimes lowered to a depth proximate a load to provide power to the load. Direct current is transmitted from a current source through the umbilical to reduce electrical loss as the current travels across the umbilical. A direct current wet connection may be formed between an electrode coupled to the umbilical and an electrode coupled to the load to allow the direct current to travel through umbilical and across the electrodes to power the load. However, direct current wet connections suffer from reliability difficulties. For example, fluids such as salt water cause corrosion to the electrodes that form the direct current wet connection, thereby, reducing the effectiveness of the direct current wet connection.

BRIEF DESCRIPTION OF THE DRAWINGS

Illustrative embodiments of the present disclosure are described in detail below with reference to the attached drawing figures, which are incorporated by reference herein, and wherein.

Figure 1A:
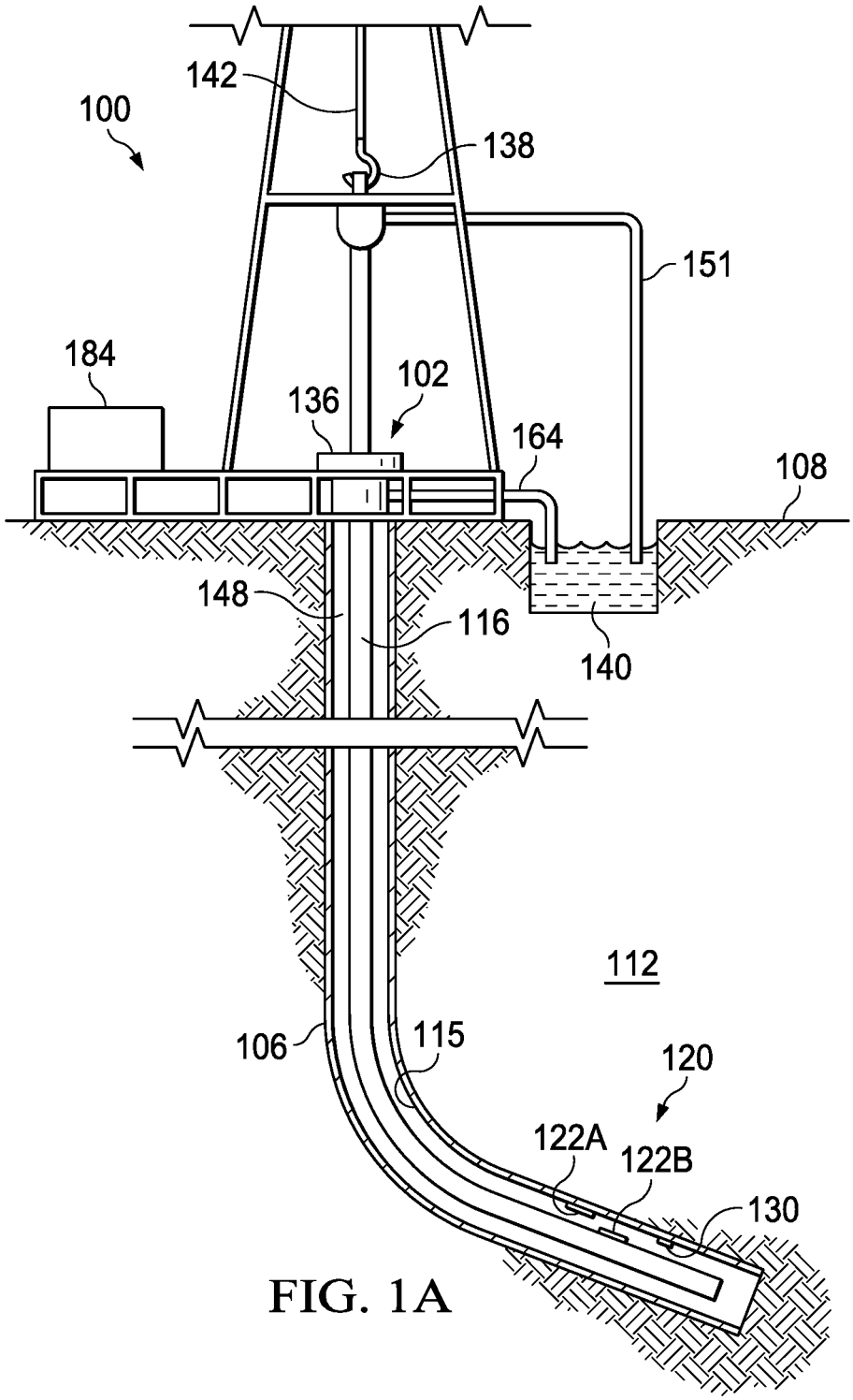
FIG. 1A is a schematic, side view of a hydrocarbon production environment having a downhole wet connection system deployed along a cased wellbore of the well and a string to provide power and telemetry to a load deployed along the casing of the well.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole wet connection systems, and methods and apparatuses to form alternating current wet connections. More particularly, the present disclosure relates to systems, apparatus, and methods to transmit power and data from a string deployed in a well to a load deployed along another string deployed in the well or deployed on another portion of the well (such as a lower completion). The system includes a first electrode that is deployed proximate to a load, and a second electrode that is deployed along the string. As defined herein, strings include permanent installations such as tubes, wellbore casings, as well as other types of strings that are permanently deployed along a wellbore. Strings also include conveyances, such as wirelines, slicklines, coiled tubings, drill pipes, production tubings, downhole tractors or other types of conveyances operable to retrievably deploy electrodes downhole. For example, the first electrode of the wet connection system may be deployed along one or more sections of a production casing deployed proximate a hydrocarbon formation and the second electrode may be deployed along a production string that is deployed within an annulus of the production casing. In some embodiments, the production casing may be considered as a lower completion.

In some embodiments, the wet connection system includes an umbilical having an electrical conduit, such as a tubing encased conductor. The umbilical is coupled to a current source and to the second electrode to provide electrical current generated by the current source to the second electrode. In one of such embodiments, direct current is transmitted along the umbilical to reduce electrical loss during current transmission. The wet connection system also includes a power convertor deployed proximate the second electrode and operable to convert direct current flowing through the umbilical to alternating current. The wet connection system also includes an electrical connector that forms a direct connection between the first and the second electrodes when such electrodes are aligned, thereby establishing an alternating current wet connection between the first and the second electrodes. In some embodiments, the wet connection system also includes another power convertor or a power de-convertor that is deployed proximate the first electrode and is operable to convert alternating current transmitted across the wet connection into direct current. In one of such embodiments, the power convertor and the power de-convertor are operable to step up and/or step down voltage across the wet connection to match the operational voltage of the load. In some embodiments, the wet connection system also includes one or more insulators placed around the first and second electrodes to insulate the first and second electrodes from the surrounding medium.

In some embodiments, the wet connection system also includes a controller (formed from one or more drive electronics) that is operable to modulate one or more of the frequency, amplitude, current density, and phase of the alternating current to regulate power transmitted to the load and also to transmit signals indicative of data or commands to the load. In one of such embodiments, the controller is operable to tune the frequency of the alternating current within a range of 10 Hz and 500 Hz to provide power transmission to the load and to tune the frequency of the alternating current within a range of 10 Hz and 1 MHz to provide data transmission to the load. In one or more of such embodiments, the controller is operable to tune the frequency of the alternating current based on the amount of corrosion across the first and/or the second electrodes. In some embodiments, a capacitive coupling system may be formed from the first and second electrodes to augment power and data transmission through the alternating current wet connection. In such embodiments, an electrical current may be transmitted across the capacitive coupling to provide power to the load.

In further embodiments, multiple alternating current wet connections are formed to improve power and/or data transmission to the load or to provide power and/or data transmission to multiple loads. In one of such embodiments, an operator may operate a surface based control to position one or more electrodes deployed along the string to align with one or more electrodes deployed along the lower completion to form multiple alternating wet connections and to transmit power and data to the load via such alternating current wet connections. Additional descriptions of the foregoing system, apparatus, and method to form electrical connections are described in the paragraphs below and are illustrated in FIGS. 1-5.

Turning now to the figures, FIG. 1A is a schematic, side view of a hydrocarbon production environment 100 having a downhole wet connection system 120 deployed along a wellbore casing (casing) 115 and a string 116 to provide power and telemetry to a load 130 deployed along the casing 115. The wet connection system 120 includes a first electrode 122A that is deployed on the casing 115 and a second electrode 122B that is deployed along the string 116. In the embodiment of FIG. 1A, a well 102 having a wellbore 106 extends from a surface 108 of the well 102 to or through a subterranean formation 112. The casing 115 extends from a surface 108 of the well 102 down wellbore 106 to insulate downhole tools and strings deployed in the casing 115 as well as hydrocarbon resources flowing through casing 115 from the surrounding subterranean formation 112, to prevent cave-ins, and/or to prevent contamination of the surrounding subterranean formation 112. The casing 115 is normally surrounded by a cement sheath (not shown) formed from cement slush, and deposited in an annulus between the casing 115 and the wellbore 106 to fixedly secure the casing 115 to the wellbore 106 and to form a barrier that isolates the casing 115. In one or more embodiments, there may be additional layers of casing concentrically placed in the wellbore 106, each having a layer of cement or the like deposited thereabout.

A hook 138, cable 142, traveling block (not shown), and hoist (not shown) are provided to lower the string 116 down the wellbore 106 or to lift the string 116 up from the wellbore 106. As stated herein, the string may be wireline, slickline, coiled tubing, drill pipe, dip tubing, production tubing, downhole tractor, or another type of conveyance operable to retrievably deploy electrodes, such as the second electrode 122B downhole. In some embodiments, an umbilical (not shown) having an electrical conduit (not shown) is coupled to the second string 116 to provide downhole power and data transmission. More particularly, the umbilical is coupled to a current source and to the second electrode 122B. The current source may be deployed on the surface 108 in the wellbore 106. In some embodiments, the current source generates direct current that travels through the umbilical downhole. In one of such embodiments, the wet connection system 120 also includes a power convertor (not shown) that is operable to convert direct current into alternating current before the alternating current is transmitted across the first and second electrodes 122A and 122B. In some embodiments, the wet connection system 120 also includes a connector, such as an electrical connector that forms a direct connection between the first electrode 122A and the second electrode 122B, thereby forming an alternating current wet connection between the first electrode 122A and the second electrode 122B. Alternating currents transmitted downhole through the umbilical may be transmitted across the alternating current wet connection to provide power or data transmission to the load 130 as well as other loads that are deployed along the casing 115. In some embodiments, the wet connection system 120 also includes a controller (not shown) formed from one or more drive electronics. In one of such embodiments, the controller is operable to receive an indication that the first and second electrodes 122A and 122B are aligned and activate the connector to form a direct connection between the first electrode 122A and the second electrode 122B. In one or more of such embodiments, the controller is operable to modulate at least one of a phase, frequency, amplitude, and current density of the alternating current to provide power and data transmission to the load 130.

At wellhead 136, an inlet conduit 151 is coupled to a fluid source (not shown) to provide fluids, such as production fluids, downhole. In some embodiments, the second string 116 has an internal passage that provides a fluid flow path from the surface 108 downhole. In some embodiments, the production fluids travel down the second string 116 and exit the string 116.

The production fluids as well as hydrocarbon resources flow back toward the surface 108 through a wellbore annulus 148, and exit the wellbore annulus 148 via an outlet conduit 164 where the production fluids and the hydrocarbon resources are captured in a container 140.

The load 130 is deployed along the casing 115. In some embodiments, the load 130 includes sensors, such as but not limited to flow rate sensors, temperature sensors, pressure sensors, flow composition sensors, magnetometers, accelerometers, pH sensors, vibration sensors, acoustic sensors, as well as other sensors that are operable to determine one or more properties of hydrocarbon resources and/or the surrounding formation 112. The load 130 may also include tools such as, but not limited to valves, sleeves, wireless communication devices, hydraulic pumps, as well as other downhole tools that are operable to monitor and maintain hydrocarbon production and the integrity of the well 102 during the operational life expectancy of the well 102. The tools and sensors may be operable to create, monitor, and maintain zonal isolation to prevent fluid loss, as well as to maintain hydrocarbon production and the integrity of the well 102 in multi-zone wells. In further embodiments, the tools and sensors are deployed proximate A-annulus, B-Annulus, C-Annulus, as well as other annuluses within the wellbore 106 to monitor the pressure, temperature, fluid flow, or other properties proximate the annuluses.

In some embodiments, the load 130 represents tools and sensors that are deployed proximate one or more types of screens to detect properties of particles flowing through the screens and are operable to form control systems (e.g., control flow devices) to monitor and regulate fluid/particle flow through the screens. In one embodiment, a first screen (not shown) is disposed on a section of casing 115. A plurality of sensors disclosed herein and operable to monitor material properties of fluids and particles proximate the screen and flowing through the screen are deployed along the casing 115. In further embodiments, the load 130 represents a set of tools disclosed herein that are operable to regulate the flow rate of fluids and materials through the first screen are also deployed along the casing 115. Electrical currents may be transmitted from the second electrode 122B, across the alternating current wet connection to the first electrode 122A to provide power and data transmission to the sensors and tools that are deployed along the casing 115. Although FIG. 1A illustrates a production well, the technologies described herein may also be implemented in an injection well to provide power and data across different strings deployed in the injection well. Further, although FIG. 1A illustrates deploying the wet connection system 120 in a downhole environment of an on shore well, the wet connection system 120 may also be deployed in a subsea environment such as in an offshore well.

In some embodiments, the foregoing operations are monitored by a surface based control 184, which includes one or more electronic systems. In one of such embodiments, the surface based control 184 is operable to receive one or more indications of whether the first electrode 122A is aligned with the second electrode 122B and to notify an operator whether the first electrode 122A is aligned with the second electrode 122B. The operator may operate the control 184 to re-position the string 116 until the first electrode 122A and the second electrode 122B are aligned. The operable may then activate the electrical connector to form a direct connection between the first and the second electrodes 121A and 121B. In other embodiments, the operator may operate the control 184 to align multiples electrodes deployed on the string 116 with multiple electrodes that are deployed on the casing 115 to provide additional power and/or data transmission to the load 130 or to provide power and/or data transmission to other loads that are deployed along other regions of the casing 115.

Figure 1B:
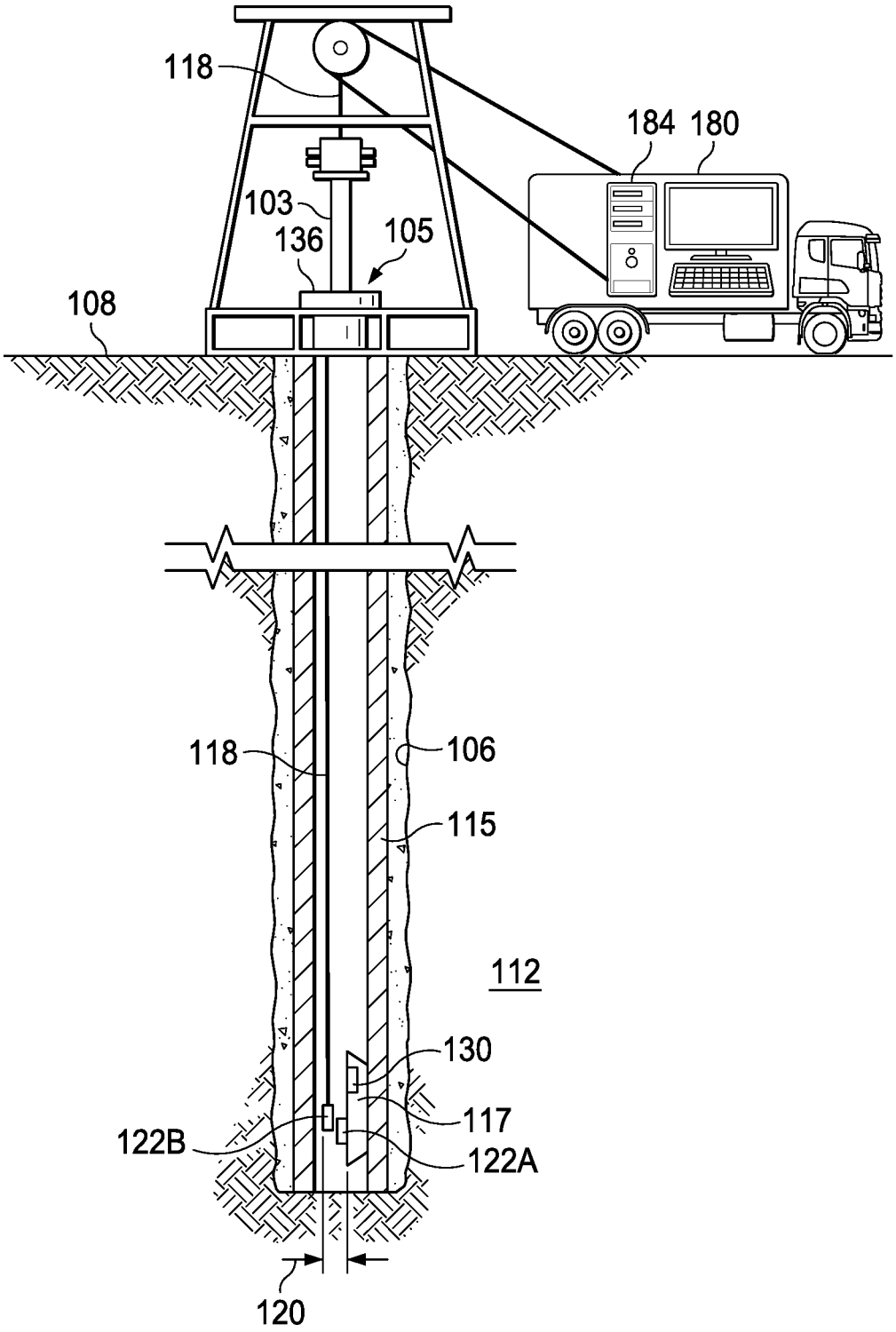
FIG. 1B is a schematic, side view of a hydrocarbon well, where the first electrode and the second electrode of the downhole wet connection system of FIG. 1A are deployed along a lower completion and a string, respectively, to provide power and telemetry to a load deployed on the lower completion.

FIG. 1B is a schematic, side view of a hydrocarbon well 105, where the first electrode 122A and the second electrode 122B of the downhole wet connection system 120 of FIG. 1A are deployed along a lower completion 117 and a string 118, respectively, to provide power and telemetry to the load 130 deployed on the lower completion 117. In the depicted embodiment, the string 118 is a retrievable conveyance formed from wireline, slickline, coiled tubing, drill pipe, downhole tractor or another type of conveyance operable to deploy the second electrode 122B to a location proximate to the load 130 during the operation of the well 105. A vehicle 180 carrying sections of the string 118 is positioned proximate the well 102. The string 118 along with the second electrode 122B are lowered through blowout preventer 103 into the well 105. In some embodiments, a logging tool (not shown) is also deployed along the string 118 to perform logging operations while the downhole wet connection system provides power and/or data transmission to the load 130. In one or more embodiments, additional tools may be deployed along the string 118 to perform one or more operations described herein.

Figure 2:
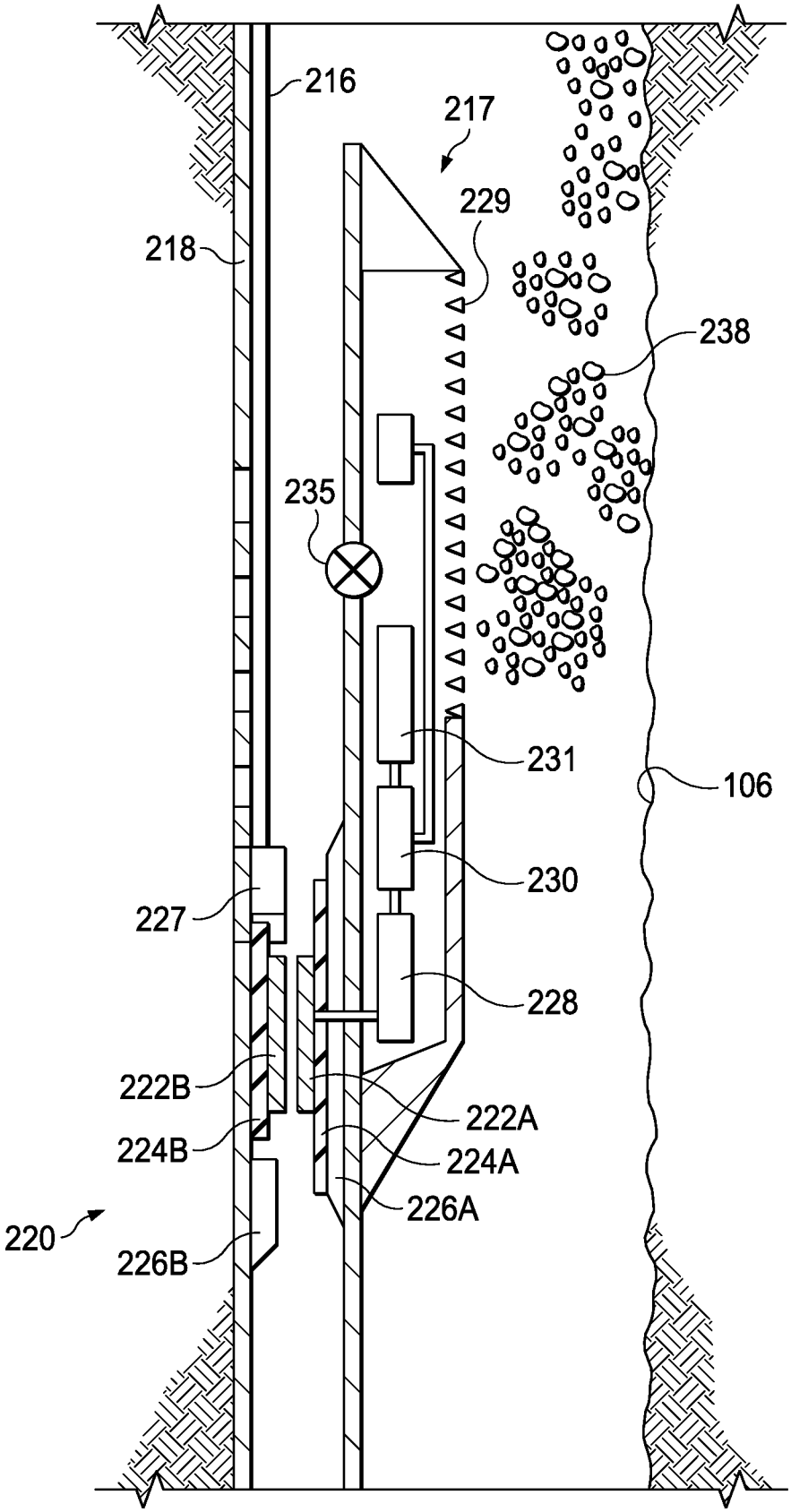
FIG. 2 is a side view of a downhole wet connection system similar to the downhole wet connection system of FIG. 1B and having a first electrode deployed on a lower completion and having a second electrode deployed along a string.

FIG. 2 is a side view of a downhole wet connection system 220 similar to the downhole wet connection system 120 of FIG. 1B and having a first electrode 222A deployed on a lower completion 217 and having a second electrode 222B deployed along a string 118. Gravel packs 238 are deployed in an annulus between the lower completion 217 and the wellbore 106 to stabilize the formation proximate the lower completion 217. The lower completion includes a filter 229, such as a sand filter, a sand screen, or another type of filter that prevents formation sand as well as other types of undesirable downhole materials from entering the lower completion 217. The lower completion 217 also includes electronic and controls ("load") 230 that monitor and control, through actuator 231 and valve 235, fluid flow through the valve 235 of the lower completion 217. In some embodiments, the load 230 also monitors the downhole environment proximate the lower completion 217, transmits data indicative of the downhole environment, and performs other wellbore operations described herein. In some embodiments, the load 230 includes or is coupled to one or more electronics or components that are operable to modulate electrical currents received at the load 230. In the depicted embodiment, a power de-convertor 228 operable to regulate voltage (step up and/or step down voltage) to match an operational voltage of the load 230 is also deployed on the lower completion 217. In one or more embodiments, the power de-convertor 228 is not deployed on the lower completion 217. In one or more of such embodiments, load 230 includes or is coupled to a rectifier that is operable to convert alternating current to direct current. In another one of such embodiments, the load 230 includes or is coupled to a band pass filter (e.g., high band pass filter, low band pass filter, etc.), band stop filter, or another component operable to filter the electrical currents based on frequency, amplitude, and/or phase. In a further one of such embodiments, the load 230 is also coupled to or includes one or more buck components, boost components, transformers, or a similar component that is operable to modulate the voltage (e.g., step up, step down, etc.) of the load 230.

The first electrode 222A is deployed on a surface of the lower completion 217 and the second electrode 222B is deployed on the string 218 to provide power and/or data transmission to the load 230. In some embodiments, the first and second electrodes 222A and 222B are manufactured from materials having a high galvanic potential, such as titanium, carbon (graphite), gold, nickel, steel, chrome, silver, platinum, alloys of the foregoing materials, hastelloy, illium alloy, incoloy, and monel. In some embodiments, the first and second electrodes 222A and 222B have curved edges to reduce current density for leakage currents, and thereby reduce likelihood of electrochemical corrosion on the edges of the first and second electrodes 222A and 222B. A first insulator 224A and a second insulator 224B are placed around the first electrode 222A and the second electrode 222B, respectively to insulate the first and second electrodes 222A and 222B. The first and second insulators 224A and 224B may be manufactured from polymer (such as Teflon, PTFE, PEEK, Thiol, and nylon), ceramic, oxide, glass, plastic, rubber (such as swell rubber, HNBR and nitrile), paint, enamel, metal oxide, anodized material, carbide coating, as well as other materials described herein. In some embodiments, the first and second insulators 224A and 224B form a fluid restriction. In some embodiments, the first and second insulators 224A and 224B may extend from 0.25 inches to 10 feet away from the first and second electrodes 222A and 222B. Additionally, the first and second insulators 224A and 224B may extend to partially cover a section of the first and second electrodes 222A and 222B, respectively.

An umbilical 216 that is also deployed along the string 218 provides a conduit for current to flow from a current source towards the first electrode 222A. In some embodiments, direct current is transmitted downhole to reduce electrical loss during current transmission. As depicted in FIG. 2, a power convertor 227 is coupled to the umbilical and to the second electrode 222B. The power convertor 227 is is operable to convert direct current transmitted along the umbilical to alternating current and to provide the alternating current to the second electrode 222B.

Connectors 226A and 226B are placed proximate to the first and second electrodes 222A and 222B, respectively, and may be actuated when the first electrode 222A and the second electrode 222B are aligned to form a direct connection between the first electrode 222A and the second electrode 222B. Examples of the connectors 226A and 226B include spring loaded electrical connector, bow-spring centralizer, coil-spring electrical connector, rubber-spring electrical connector, hydraulically activated spring electrical connector, as well as similar types of electrical connectors. In some embodiments, a controller (not shown) is deployed along the string 218 and is coupled to the umbilical 216. In some embodiments, the controller is operable to detect response signals from the first and second electrodes 222A and 222B and is further operable to determine the signal intensities of the response signals to determine whether the first and second electrodes 222A and 222B are aligned with each other. More particularly, the controller determines that the first electrode 222A is not properly aligned with the second electrode 222B if the signal intensities of the response signals are not greater than a first threshold. If the controller determines that the signal intensities of the response signals are greater than the first threshold, then controller 128 determines that the first electrode 222A is properly aligned with the second electrode 222B. Alternatively, if the controller determines that the first and the second electrodes 222A and 222B are not aligned, the controller is further operable to transmit an indication that the electrodes are not aligned. In some embodiments, the indications are transmitted via the umbilical 216 or via another telemetry system to the control 184. An operator may operate the control 184 to re-position the string 218 to align the first and second electrodes 222A and 222B.

In some embodiments, the controller is operable to modulate one or more of the frequency, amplitude, and phase of the alternating currents to regulate power transmitted to the load 230 and also to transmit data to the load 230. In one of such embodiments, the controller is operable to vary transmission frequency based on whether the transmission is a power transmission or a data transmission. More particularly, the controller is operable to vary the transmission frequency of power transmissions from 10 Hz to 100 MHz and is operable to vary the transmission frequency of data transmissions from 10 Hz to 100 MHz. The controller is further operable to vary the power transmissions within specific ranges of the foregoing power and frequency transmission ranges. In one example, the controller is operable to vary the transmission frequency of the power transmissions to 10 Hz to 500 Hz and is further operable to vary the transmission frequency of the data transmissions to 10 Hz to 1 MHz. In one example, the controller is operable to vary the transmission frequency of the power transmissions to 1 MHz to 10 MHz and is further operable to vary the transmission frequency of data transmissions to 1 kHz to 10 kHz. In one or more of such embodiments, the controller is operable to determine the amount of corrosion across the first and second electrodes 222A and 222B and vary the transmission frequency of power and data transmissions based on the amount of corrosion across the first and second electrodes 222A and 222B. For example, the controller is operable to increase the transmission frequency of power transmissions if additional corrosion is detected across the first and second electrodes 222A and 222B. In some embodiments, the controller is operable to modulate the current density of the alternating current. In one or more of such embodiments, the controller is operable to maintain the alternating current that flows across the wet connection between approximately between 100 mA and 1 A and maintain the current density of the alternating current that flows across the wet connection to less than approximately 1 $A/cm^2$.

In some embodiments, the controller is operable to monitor the power transmission, the current transfer, the voltage transfer, the signal to noise ratio (SNR), the signal to interference plus noise ratio (SINR) heat generation, a combination of the foregoing properties, or similar properties. Moreover, the controller is operable to monitor the real part of the electrical impedance (real impedance), the imaginary part of the electrical impedance (imaginary impedance), the current, the voltage, the phase of the current and/or the voltage, the amplitude, or another property of the electrical currents/signals.

In some embodiments, the first and the second electrodes 222A and 222B are covered by a first and a second coverings (not shown) to protect the first and the second electrodes 222A and 222B against corrosion. In one of such embodiments, the first and second coverings are manufactured from materials that have a high dielectric permittivity and a low electrical resistivity, and are electrically conductive. In one or more of such embodiment, the first and second coverings form a direct contact when the first and second electrodes 222A and 222B are aligned, thereby forming an alternating current wet connection. In some embodiments, the first and second coverings are manufactured from silicon carbide, silicon nitride, rubber, electrically conductive rubber or another material disclosed herein having a high dielectric permittivity. In one of such embodiments, the first and second coverings are manufactured from different materials.

Figure 3A:
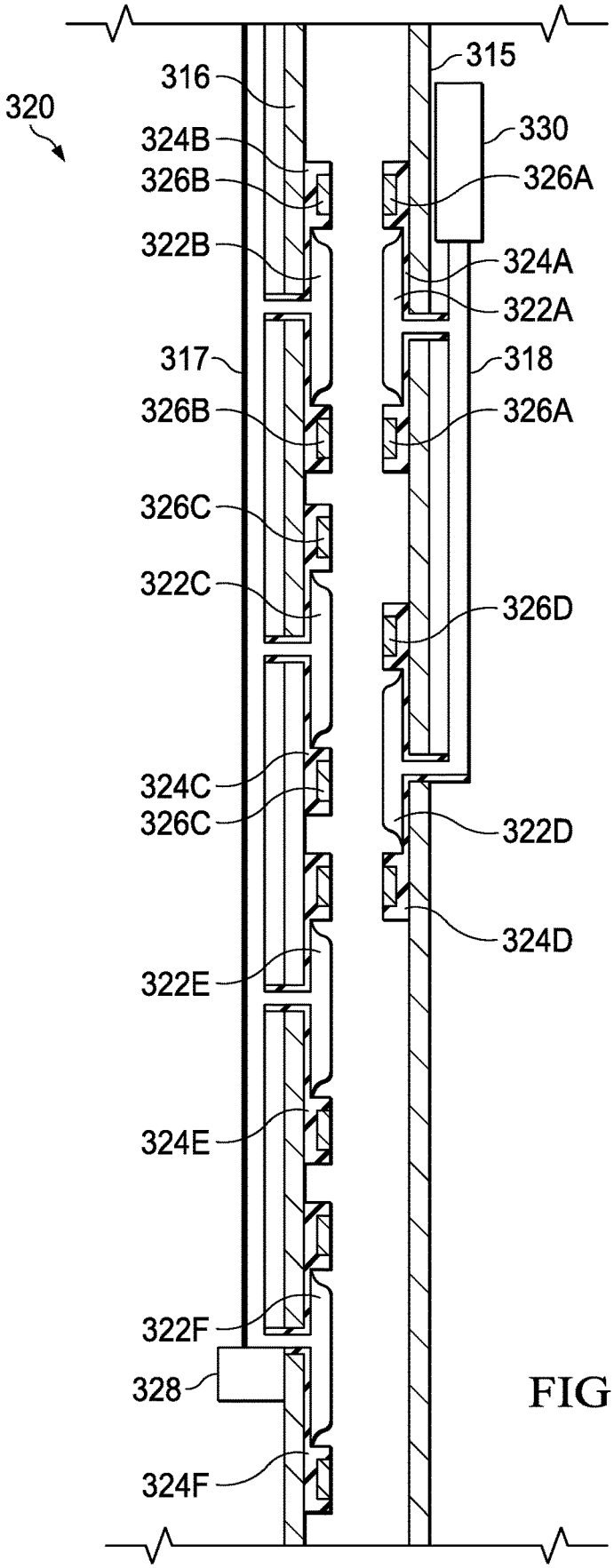
FIG. 3A is a side view of a downhole wet connection system having two electrodes deployed along a first string are aligned with two electrodes deployed along a second string.

FIG. 3A is a side view of a downhole wet connection system 320 having two electrodes 322A and 322D are deployed along a first string 315 and are aligned with two electrodes 322B and 322C that are deployed along a second string 316. In the embodiment of FIG. 3A, a first electrode 322A and a fourth electrode 322D are deployed along the first string 315, and a second electrode 322B, a third electrode 322C, a fifth electrode 322E, and a sixth electrode 322F are deployed along the second string 316. The deployment of additional electrodes provides additional alignment locations along surfaces of the first and second strings 315 and 316. The second, third, fifth, and sixth electrodes 322B, 322C, 322E, and 322F are coupled a first umbilical 317, which provides current from a current source downhole to the second, third, fifth, and sixth electrodes 322B, 322C, 322E, and 322F. A second umbilical 318 provides an electrical conduit from the first and fourth electrodes 322A and 322D to load 330.

The first-sixth electrodes 322A-322F are insulated by first-sixth insulators 324A-324F, respectively to insulate first-sixth electrodes 322A-322F. In some embodiments, one or more of the insulators 322A-322F may approach or touch each other to form a fluid restriction. For example, the second insulator 322B and the third insulator 322C may touch each other to restrict fluid across the second and third insulators 322B and 322C. In another embodiment, one of the insulators 322A-322F may approach or touch the first or the second string 315 or 316 to form a fluid restriction. For example, the second insulator 322B extends across an annulus between the first string 315 and the second string 316 and touches the first string 315. Additionally, one or more of the insulators 322A-322F may extend to partially cover a section of one or more of the electrodes 122A-122F or may extend between the one or more electrodes and the corresponding string 315 or 316.

A controller 328 is deployed along the second string 316 and is coupled to the first umbilical 317. As described herein, the controller is operable to determine whether the electrodes are properly aligned. Once the first and fourth electrodes 322A and 322D are properly aligned with the second and the third electrodes 322B and 322C, the controller 328 is further operable to actuate second and third electrical connectors 326B and 326C to contact first and fourth electrical connectors 326A and 326D to form alternating current wet connections between the first and second electrodes 322A and 322B, and between the third and fourth electrodes 322C and 322D, respectively. The controller 328 is also operable to modulate the phase, frequency, amplitude, and current density of the alternating current transmitted across the alternating current wet connections. In some embodiments, the controller 328 is further operable to convert alternating current to direct current and vice versa, and to regulate voltage across the wet connections. Additional functions of the controller 328 are described in the paragraphs above.

In some embodiments, the first and fourth electrodes 322A and 322D are covered by a first covering (not shown), and the second, third, fifth, and sixth electrodes 322B, 322C, 322E, and 322F are covered by a second covering (not shown). In some embodiments, each of the first and second coverings spans all of the electrodes covered by the respective covering. In other embodiments, the coverings are segmented such that each electrode is individually covered by one of the coverings. In some embodiments, additional electrodes are deployed on the first and second strings 315 and 316 and additional alternating current wet connections may be established between electrodes deployed on the first and second strings 315 and 316.

Figure 3B:
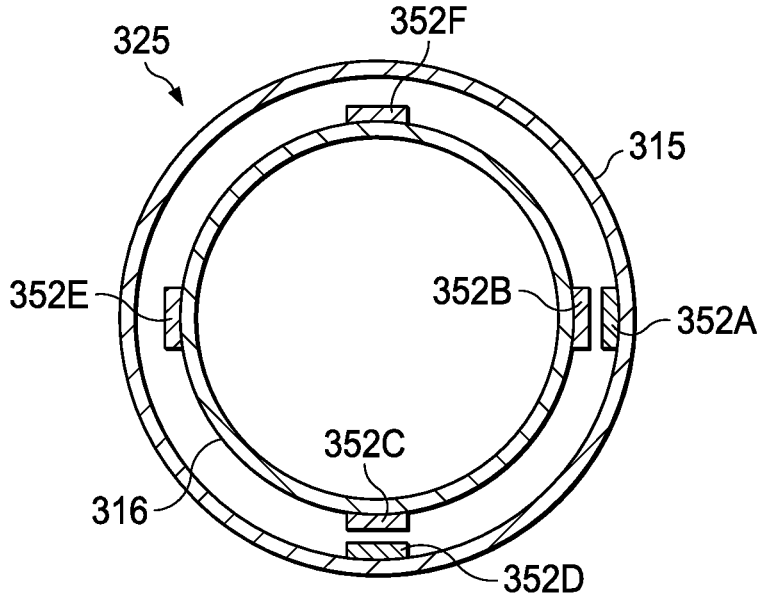
FIG. 3B is a cross-sectional view of a downhole wet connection system having multiple electrodes deployed radially along surfaces of the first string and the second string of FIG. 3A.

FIG. 3B is a cross-sectional view of an alternating current wet connection system 325 having multiple electrodes 352A-352F deployed radially along surfaces of the first string 315 and the second string 316 of FIG. 3A. As discussed herein and illustrated in the equations set forth below, power loss from the electrodes is directly proportional to the size of the surface area of the electrodes 352A-352F and the energy transfer is directly proportional to the size of the surface area of the electrodes 352A-352F. As can be seen from FIG. 3B, a wet connection has not been established with electrodes 352E and 352F because there is no matching electrodes on the first string 115. In order to reduce power loss from the electrodes 352E and 352F, the controller may choose to only provide power to electrodes 352C and 352B. In some embodiments, insulators (not shown) may be deployed radially and at circumferential locations adjacent to the electrodes 352A-352F to reduce electrical shorting between the electrodes and the string in cases where the wellbore fluid is electrically conductive and to facility other functions discussed herein.

Figure 4A:
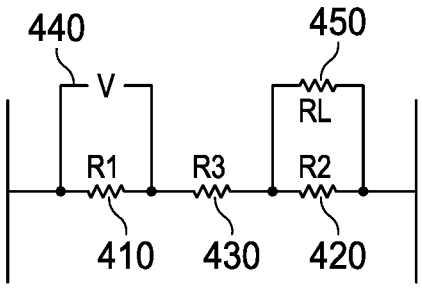
FIG. 4A is a circuit diagram of a wet connection formed by the first and the second electrodes of FIG. 3A.

FIG. 4A is a circuit diagram of a wet connection formed by the first and the second electrodes of FIG. 3A. Power to the load 130 is calculated based on the following equation:

$$P_L = \frac{1}{R_L} * V_1^2 * \left(1 - \frac{R_3 * (R_2 + R_L)}{R_3 * (R_2 + R_L) + R_2 * R_L}\right)^2,$$

where VI 440 is the voltage of the drive signal, $R_t$, 450 is the resistance across the load 130, $R_3$ 430 is the resistance across the first and second electrodes 322A and 322B, and $R_t$ 410 and $R_2$ 420 are internal resistances of the second and first electrodes 322B and 322A, respectively. Further, total power in may be calculated based on the following equation:

$$P_T = V_1^2 * \left(\frac{1}{R_1} + \frac{(R_2 + R_L)}{R_3 * (R_2 + R_L) + R_2 * R_L}\right),$$

where VI 440 is the voltage of the drive signal, $R_L$ 450 is the resistance across the load 130, $R_3$ 430 is the resistance across the first and second electrodes 322A and 322B, and $R_t$ 410 and $R_2$ 420 are internal resistances of second and first electrodes 322B and 322A respectively.

Figure 4B:
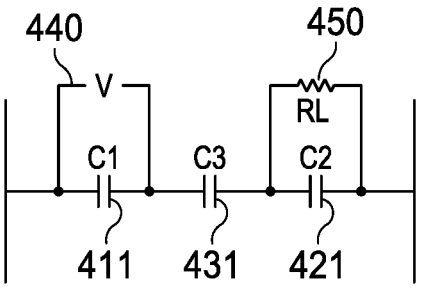
FIG. 4B is a circuit diagram of a capacitive coupling formed by the first and second electrodes of FIG. 3A.

In some embodiments, a capacitive coupling system may be formed to augment power and data transmission through the alternating current wet connection described herein. FIG. 4B is a circuit diagram of a capacitive coupling formed by the first and second electrodes 322A and 322B of FIG. 3A. The following equations may be derived and used to calculate the capacitance of the capacitive coupling, power into the load 130, as well as total power. $C_3$ 431 represents the first capacitive coupling formed between the first electrode 322A and the second electrode 322B, when the electrodes are aligned with each other. The capacitive coupling 431 may be calculated based on the following equation:

$$C_3 = \varepsilon_0 * \varepsilon_3 * \frac{A_2}{t_3},$$

where £$_0$ is the permittivity of free space, £$_3$ is the dielectric constant across the first and second electrodes 322A and 322B, $A_2$ is the surface area of the second electrode, and $t_3$ is dielectric thickness (distances between the first and second electrodes 322A and 322B). The capacitive coupling is offset by losses due to capacitive coupling $C_1$ 411 between the first electrode 322A and the first string 115, and due to capacitive coupling $C_2$ 421 between second electrode 322B and the second string 116. $C_1$ 411 may be calculated based on the following equation:

$$C_1 = \varepsilon_0 * \varepsilon_1 * \frac{A_1}{t_1},$$

where £$_0$ is the permittivity of free space, $E_1$ is the dielectric constant of the first electrode 322A, $A_1$ is the surface area of the first electrode, and $t_1$ is dielectric thickness of the first electrode 322A. Further $C_2$ 421 may be calculated based on the following equation:

$$C_2 = \varepsilon_0 * \varepsilon_2 * \frac{A_2}{t_2},$$

where £$_0$ is the permittivity of free space, $E_2$is the dielectric constant of the second electrode 322B, $A_2$ is the surface area of the second electrode, and $t_2$ is dielectric thickness of the second electrode 322B.

The circuit diagram of FIG. 4B shows half of the electrical circuit. The electrical circuit can be completed with either a second capacitive coupling (not shown), which may be formed by a second pair of electrodes. In another embodiment, the electrical circuit can be completed with a resistive coupling, which may be formed if the first and second strings 315 and 316 are in direct contact with each other. In a further embodiment, the electrical circuit is completed with a combination of capacitive coupling and resistive coupling. Further in some embodiments, one or more inductors (not shown) may be added in parallel or in series to the drive side of the circuit illustrated in FIG. 4B, in parallel or in series to the load side of the circuit, to both the drive side and load side, or to a ground to form a resonant system for power transmission. In one of such embodiments, the resonant system further augments power transmission efficiency across the capacitive coupling 431.

Figure 5:
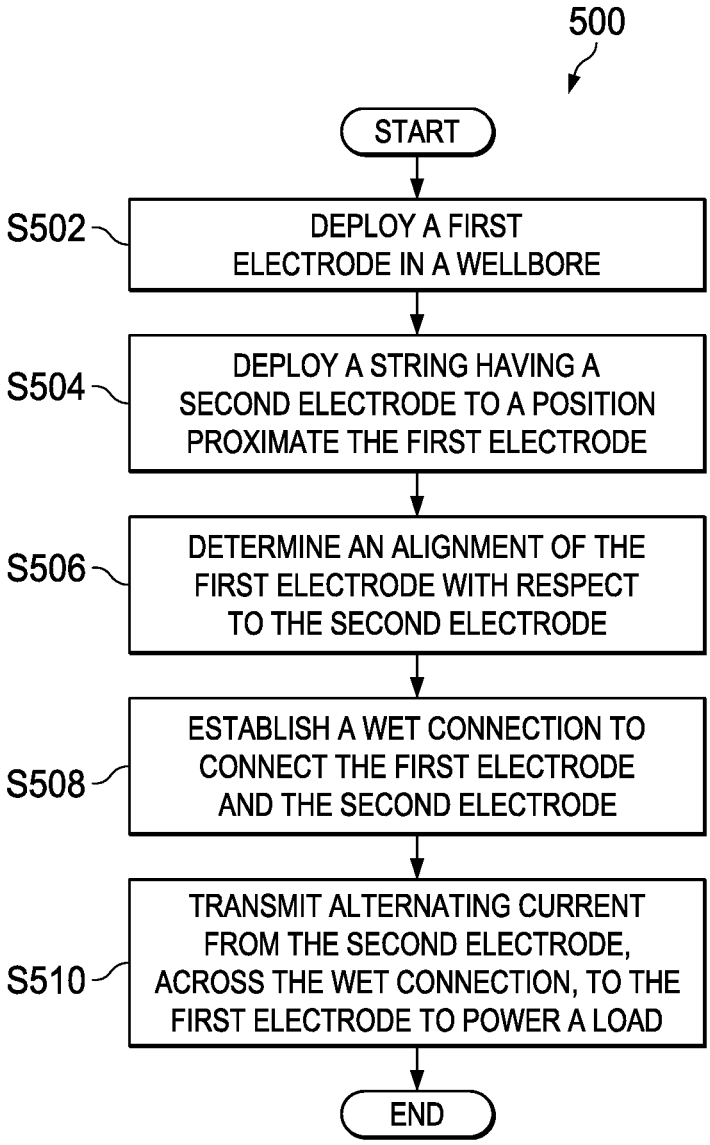
FIG. 5 is a flow chart of a process to form an electrical connection between the first and the second strings.

FIG. 5 is a flow chart of a process to form an alternating current wet connection. Although operations in the process 500 are shown in a particular sequence, certain operations may be performed in different sequences or at the same time where feasible.

At step 502, the first electrode 122A is deployed in the wellbore 106. In some embodiments, the first electrode 122A is permanently deployed in the wellbore 106 during the operation of the well 102, whereas the second electrode 122B is deployed along a retrievable string that may be removed from the wellbore 106 during the operation of the well 102. In some embodiments, an umbilical, such as the first umbilical 317, is coupled to a current source to provide a conduit for the current source to transmit current downhole to the second electrode 122B. At step 506, a determination of whether the second electrode 122B is aligned with the first electrode 122A is made. In some embodiments, a controller, such as the controller 328, is operable to detect signals indicative of whether the second electrode 122B is aligned with the first electrode 122A.

At step 508, a wet connection is established to directly connect the first electrode 122A with the second electrode 122B when the first and second electrodes 122A and 122B are aligned. In some embodiments, the controller 328 actuates an electrical connector described herein to establish the wet connection. In some embodiments, the controller 128 is operable to modulate at least one of the amplitude, frequency, current density, and phase to regulate power and data transmission. In one of such embodiments, the controller 328 is operable to modulate the frequency of the alternating current within a range of approximately between 10 Hz and 500 Hz to provide power transmission to the load, and to modulate the frequency of the alternating current within a range of approximately between 10 Hz and 1 MHz to provide data transmission to the load. In other embodiments, the controller 328 is operable to modulate the frequency of the alternating current within a different range described herein to provide power and/or data transmission to the load. In some embodiments, the controller 328 is operable to determine an amount of corrosion across the first and second electrodes 122A and 122B and to modulate the frequency of the alternating current based on the amount of corrosion on the first and second electrodes 122A and 122B. In one or more embodiments, the controller 328 is operable to maintain the alternating current that flows across the first wet connection between approximately between 100 mA and 1 A and maintain the current density of the alternating current that flows across the wet connection to less than approximately 1 A/cm$^2$. At step 510, alternating current is transmitted from the second electrode 122B, across the wet connection, to the first electrode 122A to power a load.

In some embodiments, direct current is transmitted from the current source to the second electrode 122B to reduce transmission current loss. In one of such embodiments, the controller 328 and/or a power convertor deployed proximate to the second electrode 122B converts direct current to alternating current and provides alternating current across the alternating current wet connect to the first electrode 122B. In one of such embodiments, the controller 328 and/or a power de-convertor then converts alternating current at the first electrode 122A into direct current, which is then transmitted to the load.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a downhole wet connection system, comprising a first electrode deployed in a wellbore, the first electrode being coupled to a load deployed in the wellbore; and a second electrode deployed along a string deployed in the wellbore and proximate to the first electrode, wherein the first electrode and the second electrode are operable to form a wet connection to transmit alternating current from the second electrode to the first electrode.

Clause 2, the downhole wet connection system of clause 1, further comprising: an umbilical deployed along the string and connected to a direct current source; and a first power convertor deployed proximate the second electrode and operable to convert direct current flowing across the umbilical into alternating current.

Clause 3, the downhole wet connection system of clause 1 or 2, further comprising a second power convertor deployed proximate to the first electrode and operable to convert the alternating current flowing from the first electrode to direct current.

Clause 4, the downhole wet connection system of at least one of clauses 1-3, wherein the second power convertor is operable to regulate voltage to match an operational voltage of the load.

Clause 5, the downhole wet connection system of at least one of clauses 1-4, further comprising a controller operable to modulate at least one of a phase, frequency, amplitude, and current density of the alternating current to provide power and data transmission to the load.

Clause 6, the downhole wet connection system of at least one of clauses 1-5, wherein the controller is further operable to: modulate the frequency of the alternating current within a range of approximately between 10 Hz and 500 Hz to provide power transmission to the load, and modulate the frequency of the alternating current within a range of approximately between 10 Hz and 1 MHz to provide data transmission to the load.

Clause 7, the downhole wet connection system of at least one of clauses 1-6, wherein the controller is operable to modulate the frequency of the alternating current based on a corrosion level across at least one of the first electrode and the second electrode.

Clause 8, the downhole wet connection system of at least one of clauses 1-7, further comprising a spring loaded electrical connector operable to form a direct connection between the first electrode and the second electrode.

Clause 9, the downhole wet connection system of at least one of clauses 1-8, wherein the spring loaded electrical connector is at least one of a bow-spring centralizer, coil-spring electrical connector, rubber-spring electrical connector, and hydraulically activated spring electrical connector.

Clause 10, the downhole wet connection system of at least one of clauses 1-9, further comprising: a first insulator positioned proximate the first electrode to insulate the first electrode; and a second insulator positioned proximate the second electrode to insulate the second electrode.

Clause 11, the downhole wet connection system of at least one of clauses 1-10, wherein the first electrode and the second electrode are operable to form a capacitive coupling between said first electrode and said second electrode to provide power to the load.

Clause 12, a method to form a downhole alternating current wet connection, the method comprising: deploying a first electrode in a wellbore, the first electrode being coupled to a load deployed proximate to the first electrode; deploying a string having a second electrode proximate to the first electrode; determining an alignment of the first electrode with respect to the second electrode; establishing a wet connection to connect the first electrode and the second electrode when the first electrode and the second electrode are aligned; and transmitting an alternating current from the second electrode, across the wet connection, to the first electrode to power the load.

Clause 13, the method of clause 12, further comprising: transmitting a direct current, from a current source, along an umbilical deployed along the string, to the second electrode; and converting the direct current into the alternating current before the alternating current is transmitted across the wet connect.

Clause 14, the method of clause 12 or 13, wherein establishing the wet connection comprises actuating a spring loaded electrical connector to form a direct connection between the first electrode and the second electrode.

Clause 15, the method of at least one of clauses 12-14, further comprising modulating at least one of a phase, frequency, current density, and amplitude of the alternating current.

Clause 16, the method of at least one of clauses 12-15, further comprising: modulating the frequency of the alternating current within a range of approximately between 10 Hz and 500 Hz to provide power transmission to the load, and modulating the frequency of the alternating current within a range of approximately between 10 Hz and 1 MHz to provide data transmission to the load.

Clause 17, the method of at least one of clauses 12-16, further comprising: determining an amount of corrosion across at least one of the first electrode and the second electrode; and modulating the frequency of the alternating current based on the amount of corrosion on at least one of the first electrode and the second electrode.

Clause 18, the method of at least one of clauses 12-17, further comprising: maintaining the alternating current that flows across the first wet connection between approximately between 100 mA and 1 A; and maintaining the current density of the alternating current that flows across the wet connection to less than approximately 1 A/cm$^2$.

Clause 19, an apparatus to form a downhole alternating current wet connection, comprising: a first electrode deployed in a wellbore; a second electrode deployed along a string and positioned proximate to the first electrode; a spring loaded electrical connector operable to directly connect the first electrode and the second electrode to establish a wet connection between the first electrode and the second electrode, wherein an alternating current flows across the wet connection; and a controller operable to modulate at least one of a frequency, phase and amplitude of the alternating current to provide at least one of power and data transmission to a load deployed proximate the first electrode.

Clause 20, the apparatus of clause 19, wherein the controller is operable to modulate the frequency of the alternating current based on a corrosion level across at least one of the first electrode and the second electrode.

Although certain embodiments disclosed herein describes transmitting electrical currents from electrodes deployed on an inner string to electrodes deployed on an outer string, one of ordinary skill would understand that the subject technology disclosed herein may also be implemented to transmit electrical currents from electrodes deployed on the outer string to electrodes deployed on the inner string.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole wet connection system, comprising:

a first electrode deployed in a wellbore, the first electrode being coupled to a load deployed in the wellbore;

a second electrode deployed along a string deployed in the wellbore and proximate to the first electrode, and a power convertor deployed proximate to the first electrode and operable to convert the alternating current flowing from the first electrode to direct current, wherein the first electrode and the second electrode are operable to form a wet connection to transmit alternating current from the second electrode to the first electrode.

2. The downhole wet connection system of claim 1, further comprising:

an umbilical deployed along the string and connected to a direct current source; and a second power convertor deployed proximate the second electrode and operable to convert direct current flowing across the umbilical into alternating current.

3. The downhole wet connection system of claim 1, wherein the second power convertor is operable to regulate voltage to match an operational voltage of the load.

4. The downhole wet connection system of claim 1, further comprising a controller operable to modulate at least one of a phase, frequency, amplitude, and current density of the alternating current to provide power and data transmission to the load.

5. The downhole wet connection system of claim 4, wherein the controller is further operable to:

modulate the frequency of the alternating current within a range of approximately between 10 Hz and 500 Hz to provide power transmission to the load, and modulate the frequency of the alternating current within a range of approximately between 10 Hz and 1 MHz to provide data transmission to the load.

6. The downhole wet connection system of claim 4, wherein the controller is operable to modulate the frequency of the alternating current based on a corrosion level across at least one of the first electrode and the second electrode.

7. The downhole wet connection system of claim 1, further comprising a spring loaded electrical connector operable to form a direct connection between the first electrode and the second electrode.

8. The downhole wet connection system of claim 7, wherein the spring loaded electrical connector is at least one of a bow-spring centralizer, coil-spring electrical connector, rubber-spring electrical connector, and hydraulically activated spring electrical connector.

9. The downhole wet connection system of claim 1, further comprising:

a first insulator positioned proximate the first electrode to insulate the first electrode; and a second insulator positioned proximate the second electrode to insulate the second electrode.

10. The downhole wet connection system of claim 1, wherein the first electrode and the second electrode are operable to form a capacitive coupling between said first electrode and said second electrode to provide power to the load.

11. A method to form a downhole alternating current wet connection, the method comprising:

deploying a first electrode in a wellbore, the first electrode being coupled to a load deployed proximate to the first electrode;

deploying a string having a second electrode proximate to the first electrode;

determining an alignment of the first electrode with respect to the second electrode;

establishing a wet connection to connect the first electrode and the second electrode when the first electrode and the second electrode are aligned;

transmitting an alternating current from the second electrode, across the wet connection, to the first electrode to power the load; and converting the alternating current flowing from the first electrode to direct current.

12. The method of claim 11, further comprising:

transmitting a direct current, from a current source, along an umbilical deployed along the string, to the second electrode; and converting the direct current into the alternating current before the alternating current is transmitted across the wet connection.

13. The method of claim 11, wherein establishing the wet connection comprises actuating a spring loaded electrical connector to form a direct connection between the first electrode and the second electrode.

14. The method of claim 11, further comprising modulating at least one of a phase, frequency, current density, and amplitude of the alternating current.

15. The method of claim 14, further comprising:

modulating the frequency of the alternating current within a range of approximately between 10 Hz and 500 Hz to provide power transmission to the load, and modulating the frequency of the alternating current within a range of approximately between 10 Hz and 1 MHz to provide data transmission to the load.

16. The method of claim 15, further comprising:

determining an amount of corrosion across at least one of the first electrode and the second electrode; and modulating the frequency of the alternating current based on the amount of corrosion on at least one of the first electrode and the second electrode.

17. The method of claim 15, further comprising:

maintaining the alternating current that flows across the first wet connection between approximately between 100 mA and 1A; and maintaining the current density of the alternating current that flows across the wet connection to less than approximately $1A/cm^2$.

18. An apparatus to form a downhole alternating current wet connection, comprising:

a first electrode deployed in a wellbore;

a second electrode deployed along a string and positioned proximate to the first electrode;

a spring loaded electrical connector operable to directly connect the first electrode and the second electrode to establish a wet connection between the first electrode and the second electrode, wherein an alternating current flows across the wet connection;

a power convertor deployed proximate to the first electrode and operable to convert the alternating current flowing from the first electrode to direct current; and a controller operable to modulate at least one of a frequency, phase and amplitude of the alternating current to provide at least one of power and data transmission to a load deployed proximate the first electrode.

19. The apparatus of claim 18, wherein the controller is operable to modulate the frequency of the alternating current based on a corrosion level across at least one of the first electrode and the second electrode.

* * * * *